US005583519A

United States Patent [19]

Koike

[11] Patent Number: 5,583,519

[45] **Date of Patent: *Dec. 10, 1996**

[54] EXTENDABLE ANTENNA FOR A RADIO TRANSCEIVER

[75] Inventor: Noboru Koike, Tokyo, Japan

[73] Assignee: Kabushiki Kaisha Toshiba, Kanagawa-ken, Japan

[ * ] Notice: The term of this patent shall not extend beyond the expiration date of Pat. No. 5,521,605.

[21] Appl. No.: 49,420

[22] Filed: Apr. 20, 1993

Related U.S. Application Data

[62] Division of Ser. No. 654,963, Feb. 14, 1991, abandoned.

[30] Foreign Application Priority Data

Feb. 23, 1990 [JP] Japan ..... 2-041281

[51] Int. Cl.[6] ..... H01Q 1/24

[52] U.S. Cl. ..... 343/702; 343/895; 343/900

[58] Field of Search ..... 343/702, 895, 343/900, 901, 715, 903, 752, 749; H01Q 1/24

[56] References Cited

U.S. PATENT DOCUMENTS

| | | | |
|---|---|---|---|
| 3,087,117 | 4/1963 | Mitchell | 343/702 |
| 4,095,229 | 6/1978 | Elliott | 343/715 |
| 4,104,639 | 8/1978 | Muchiarone | 343/900 |
| 4,121,218 | 10/1978 | Irwin et al. | 343/702 |
| 4,190,841 | 2/1980 | Harada | 343/903 |
| 4,598,295 | 7/1986 | Murphy | 343/702 |
| 4,725,845 | 2/1988 | Phillips | 343/702 |
| 4,860,024 | 8/1989 | Eqashira | 343/702 |
| 4,862,182 | 8/1989 | Egashira | 343/702 |
| 4,868,576 | 9/1989 | Johnson, Jr. | 343/702 |
| 4,890,114 | 12/1989 | Eqashira | 343/702 |
| 4,958,382 | 9/1990 | Imanishi | 343/702 |
| 5,204,687 | 4/1993 | Elliott et al. | 343/702 |

FOREIGN PATENT DOCUMENTS

| | | | |
|---|---|---|---|
| 0301175 | 2/1989 | European Pat. Off. | 343/702 |
| 57-118403 | 7/1982 | Japan . | |
| 58-109311 | 7/1983 | Japan . | |
| 62-30405 | 2/1987 | Japan . | |
| 62-42306 | 3/1987 | Japan . | |
| 1-129503 | 5/1989 | Japan . | |
| 1-160101 | 6/1989 | Japan . | |
| 1-204504 | 8/1989 | Japan | H01Q 1/50 |

*Primary Examiner*—Hoanganh Le
*Attorney, Agent, or Firm*—Finnegan, Henderson, Farabow, Garrett & Dunner, L.L.P.

[57] ABSTRACT

This extendable antenna is related to an extendable antenna for a portable radio transceiver. The antenna has a first antenna portion and a second antenna portion connected with a connecting portion of the first antenna portion. The first antenna has a loading coil which is enclosed in a top end cap. When the second antenna portion is retracted into a housing, the connecting portion is held by a holding member disposed in the top of the housing, and the connecting portion is ellectrically connected with the circuitry of the transceiver via the holding member. Furthermore, the electrical length of the loading coil is a quarter wavelength, while the physical length of the loading coil is much less than a quarter wavelength. Accordingly, even if the top end cap is only located out of the housing, the first antenna portion detects a radio frequency signal. Furthermore it is unnecessary for the radio transceiver to have an inner antenna and a rod antenna, and switching means for switching from the rod antenna to the inner antenna. And it is unnecessary for the housing to have space for the the inner antenna.

60 Claims, 6 Drawing Sheets

EXTENDABLE ANTENNA FOR A RADIO TRANSCEIVER

This is a division of application Ser. No. 07/654,963, filed Feb. 14, 1991, now abandoned.

BACKGROUND OF THE INVENTION

This present invention is related to an extendable antenna for a radio transceiver and more particularly to an antenna for a portable radio transceiver.

Extendable antennas have been developed to reduce the size of the portable radio tranceiver. A conventional antenna is shown in FIG. 8, 9 and 10. In FIG. 10, a dash line shows the state of the antenna retracted into a housing 1 of a radio transceiver 2. This state is defined as a retracted mode in the description below. A two-dot chain line shows the state of the antenna extended. This state is defined as an extended mode. The extended mode is shown in FIG. 8. A printed circuit board 5 (a PC board 5) is disposed in the housing 1, and high frequency components are mounted on the PC board 5. A coupling member 7 is mounted on the PC board 5 and connected with a duplexer (not shown). The duplexer is connected with a transmitter and a reciver (not shown), also on the PC board 5. The duplexer the transmitter and the receiver act as the circuitry of the transceiver 2.

A metal ring 9 has a female-screw portion and is inserted into the housing 1 and fitted. The coupling member 7 is connected with the metal ring 9. A holding member 11 has a male-screw portion, and the male-screw portion is screwed into the metal ring 9. The holding member 11 has some elastic tongues 11*a* for holding an antenna 3. Since the holding member 11 is metal, the coupling member 7 is electrically connected with the holding member 11.

The antenna 3 has a stopper portion 3*a* at a bottom portion, a top end cap 3*b* at a top portion, and a core portion 3*c* coupled to the stopper portion 3*a* and the top end cap 3*b*.

As shown in FIG. 8, when the antenna 3 is extended from the housing 1, the stopper portion 3*a* is engaged with a top of the tongues 11*a* and the stopper portion 3*a* is held by the tongues 11*a*. Since the stopper portion 3*a* and the core portion 3*c* are conductive material, the core portion 3*c* is electrically connected with the circuitry of the transceiver 2.

On the other hand, as shown in FIG. 9, when the antenna 3 is pushed down toward the housing 1, the top end cap 3*b* is held in the tongues 11*a*. In this state the top end cap 3*b* is held by the toungues 11*a*. However, the top end cap 3*b* is plastic, therefore the antenna 3 is not electrically connected with the circuitry. Accordingly, the antenna 3 does not detect a radio frequency signal (RF signal) in the retracted mode.

When an operator does not wish to operate the transceiver, he often retracts the extendable antenna and thus reduces the antenna's projection to make the transceiver a suitable size for carrying. When the RF signal comes to the trasceiver 2 in the retracted mode, the antenna 3 does not detect the RF signal. Therefore, to detect the RF signal, the operator must extend in advance the antenna 3 out of the housing.

To solve this deficiency, it is considered that a top end cap is conductive material and that the circuitry is electrically connected with the top end cap and an antenna core portion in the retracted mode. However, the electrical length of the top end cap is much less than the well known length of whip antennas having large gain (for example, a quarter wavelength). Accordingly the top end cap does not detect the RF signal. Furthermore in the retracted mode, almost all of the antenna core portion is located into the housing. However, there are shielding cases povided on the PC board to shield components (on the PC board) against interfering electric waves. These cases and the operator's hand interupt the RF signal which comes to the antenna core and therefore result in much reduction in a radiation efficiency. Accordingly the antenna core does not detect the RF signal.

To solve deficiency above, it is considered that the transceiver has an inner antenna and a rod antenna. The inner antenna may detect the RF signal when the rod antenna is retracted into the housing 10. However, the transceiver must detect the state in which the rod antenna is retracted and needs to have switching means for switching from the rod antenna to the inner antenna. Furthermore, the transceiver needs to have a conductive partition wall between the components and the inner antenna so that the components are not radiated by the inner antenna. Thus the transceiver needs to contain the inner antenna, the switching means and the conductive patition wall, therefore the size of the housing is large. Furthermore, the inner antenna is obliged to be disposed at an upper portion of the housing so that the inner antenna is not interrupted by the operator's hand when the RF signal comes to the transceiver. Therefore, other components may not disposed at the upper portion of the housing, as a result the inner antenna limits the area of possible location of the components.

SUMMARY OF THE INVENTION

Accordingly, it is an object of the present invention to provide an improved extendable antenna which detects a RF signal when the antenna's projection is reduced to make the transceiver a suitable size for carrying.

It is also the object of the present invention to provide an improved extendable antenna for the transceiver which eliminates the need of an inner antenna in the housing.

DESCRIPTION OF THE PREFERRED EMBODIMENT

Figure 4:
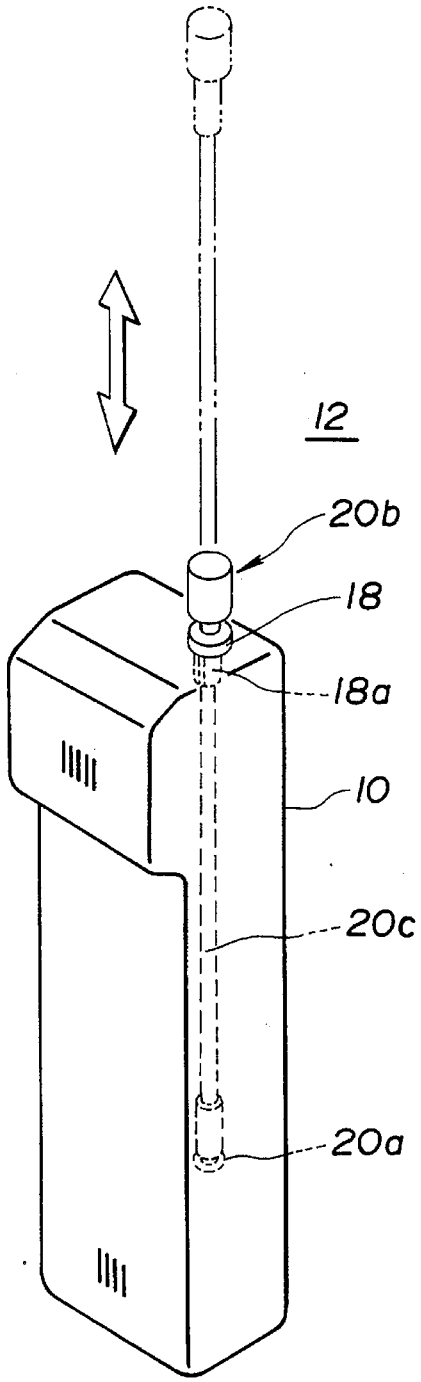
FIG. 4 is a perspective view which illustrates the portable radio transceiver including the preferred embodiment of the invention.

As shown in FIG. 4, an extendable antenna 20 is provided at a housing 10 of a portable radio transceiver 12. The antenna 20 comprises a first antenna portion 20*b* and a second antenna portion 20*c* connected with the first antenna portion 20*b*.

The first antenna portion 20*b* has a circular top end cap 21. A holding member 18 is provided at the the top of housing 10, and has elastic tongues 18*a*. The holding member 18 is conductive material and has a circular hole. The diameter of the top end cap 21 is larger than the inner diameter of the circular hole of the holding member 18. Therefore, when the second antenna portion 20*c* is retracted into the housing 10, the top end cap 21 strikes against the top surface of the housing 10 and is located out of the housing.

Figure 3:
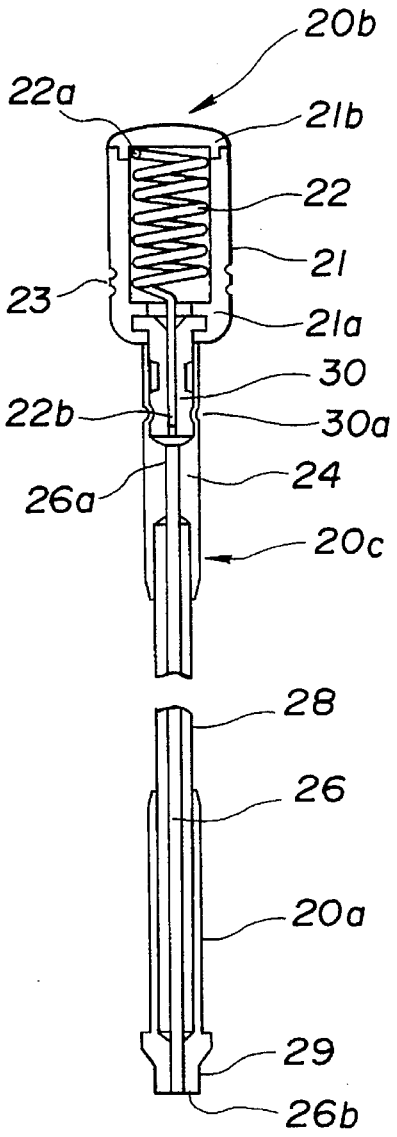
FIG. 3 is a cut-away elevational view which illustrates the antenna.

As shown in FIG. 3, a loading coil 22 is enclosed in the top end cap 21. The loading coil 22 is a helical winding composed of a piano wire. An outer housing of the top end cap 21 is plastic. The outer housing of the top end cap 21 is composed of a case 21*a* and a cover 21*b*. A metal fitting 30 is inserted and fitted into the case 21*a*. A bottom portion 22*b* of the loading coil 22 is inserted into the metal fitting 30. The cover 21*b* is fitted to the case 21*a*. The case 21*a* has a groove 23. When an operator rants to extend the antenna 20 from the housing 10, he may handle the groove 23.

An enclosed fitting 24 is brass. The metal fitting 30 is inserted into one end of the enclosed fitting 24. A portion 30*a* of the enclosed fitting 24 is compulsorily gripped and reformed by a tool. Therefore, the loading coil 22 is electrically connected with the metal fitting 30 and the enclosed fitting 24.

Figure 2:
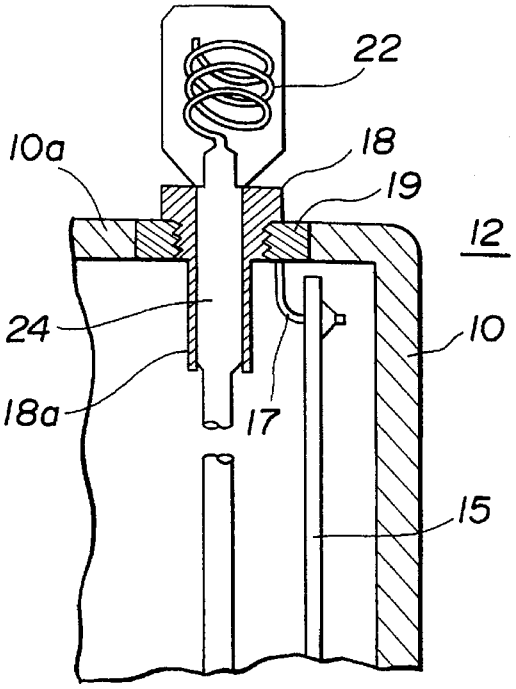
FIG. 2 is a partially cut-away elevational view which illustrates a portable radio transceiver including a preferred embodiment of the invention in the retracted mode.

As shown in FIG. 2, when the second antenna is retracted into the housing (this state is defined as a retracted mode), the enclosed fitting 24 is held by the tongues 18*a* of a holding member 18. This holding member 18 is fitted to a metal ring 19, and the metal ring 19 is fitted in the top portion 10*a* of the housing and connected with a coupling member 17. The coupling member 17 is connected with the circuitry of the trnsceiver 12 (not shown) on a printed cicuit board 15 (a PC board 15). Therfore, in the retracted mode, the loading coil 22 is electrically connected with the the circuitry of the trnsceiver 12 via the enclosed fitting 24 and the holding member 18. Thus, the enclosed fitting 24 acts as a connecting portion which connects the loading coil 22 with the circuitry of the transceiver in the retracted mode, and connects the first antenna portion 20*b* with the second antenna portion 20*c*. Furthermore, the holding member 18 acts as a feeding portion.

As shown in FIG. 3, an antenna core 26 is composed of a flexible stainless wire. Pipe 28 is composed of a flexible polyoxymethylene. The antenna core 26 is inserted into the pipe 28. The pipe 28 is inserted into other end of the enclosed fitting 24.

The second antenna portion 20*c* has a stopper portion 20*a* composed of brass. The pipe 28 having the antenna core 26 is inserted into the stopper portion 20*a*. An end portion 26*b* of the stopper portion 20*a* is compulsorily gripped and reformed a tool. Thus, the antenna core 26 is electrically connected with the stopper portion 20*a*.

Figure 1:
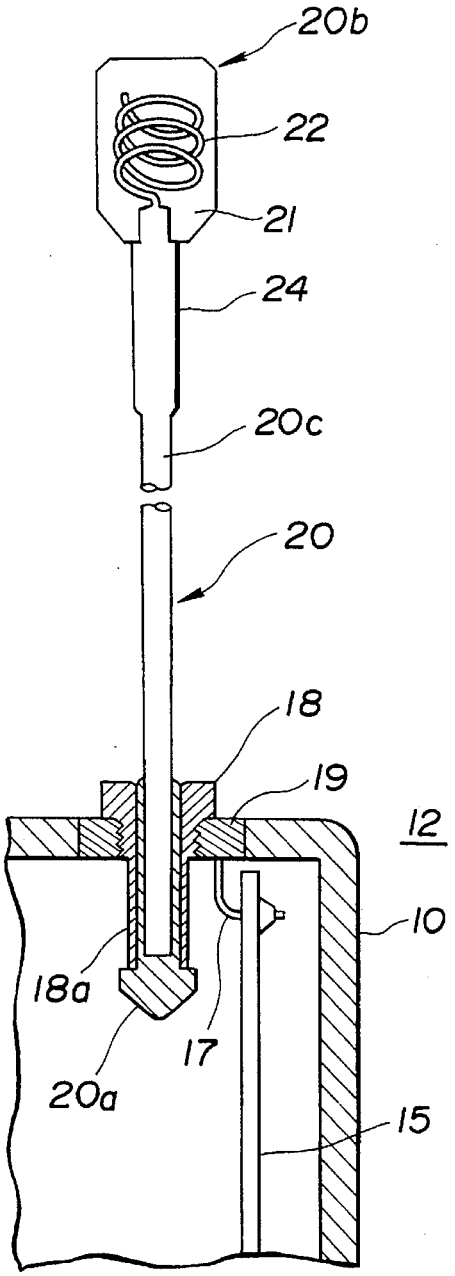
FIG. 1 is a partially cut-away elevational view which illustrates a portable radio transceiver including a preferred embodiment of the invention in the extended mode.

As shown in FIG. 1, when the antenna 20 is extented, the stopper portion 20*a* is engaged with the top of the tongues 18*a* and is held by the tongues 18*a*. Accordingly, when the antenna is extended (this state is defined as an extended mode), the antenna core 26 is electrically connected with the circuitry of the transceiver 12 via the stopper portion 20*a* and the holding member 18.

As shown in FIG. 3, the loading coil 22 is helically wound, and its electrical length from a top portion 22*a* to the bottom portion 22*b* is a quarter wavelength, while its physical length is much less than a quarter wavelength. When the second antenna portion 20*c* is retracted into the housing 10, the bottom portion 22*b* of the loading coil 22 is located at the top portion 10*a* of the housing 10. Accordingly, the bottom portion 22*b* of the loading coil 22 is electrically connected with the holding member 18 (the feeding portion). That is to say, the retracted mode is equivalent to a state in which a quarter wavelength rod antenna is located on the top portion 10*a* of the housing 10.

On the other hand, the length from a top portion 26*a* to a bottom portion 26*b* of the antenna core 26 is a quater wavelength. As a result, the electrical length from the bottom portion 26*b* to the top portion 22*a* of the loading coil 22 is a half wavelength. Therefore, the extended mode is equivalent to a state in which a half wavelength rod antenna is located on the top portion 10*a*.

Figure 5:
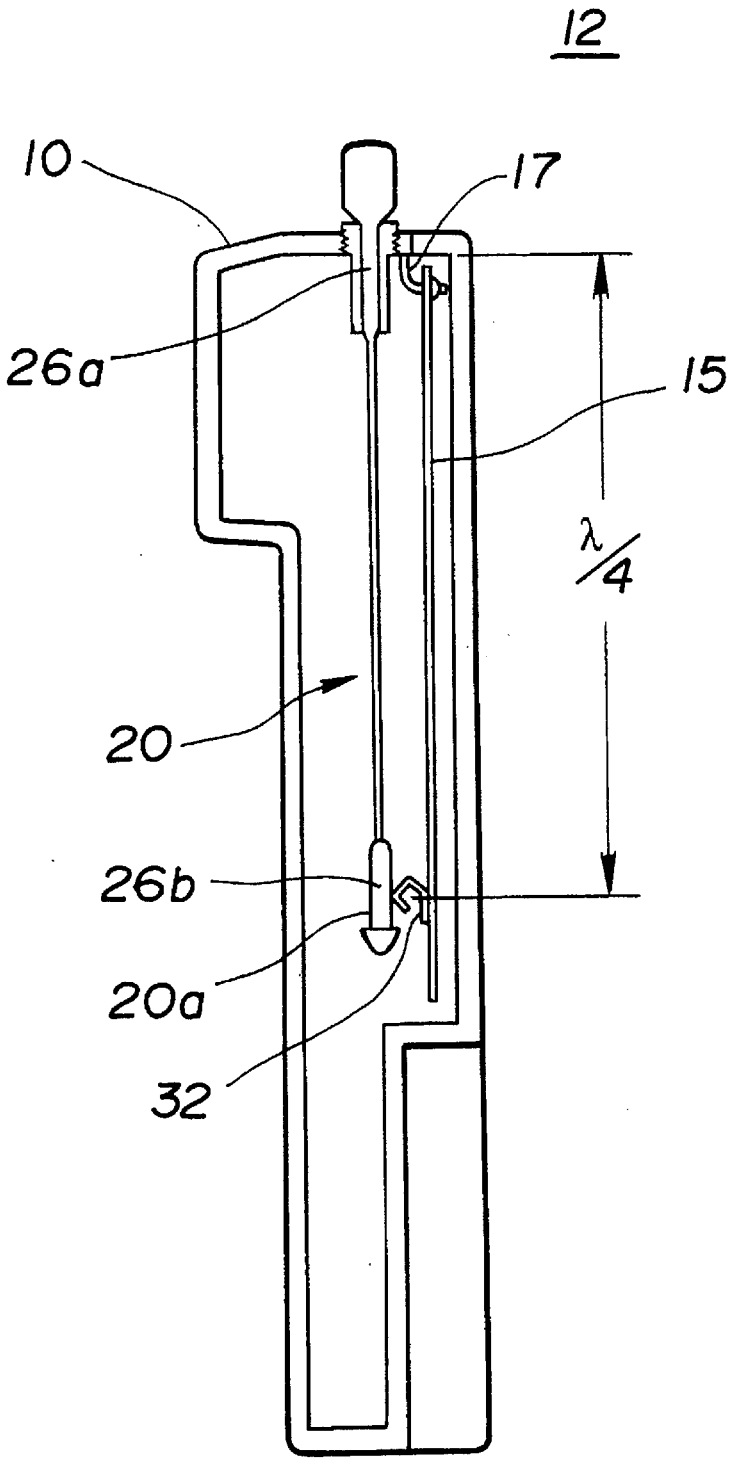
FIG. 5 is a cut-away side view which illustrates the portable radio transceiver.

As shown in FIG. 4, in the retracted mode, since the second antenna portion 20*c* is entirely retracted into the housing 10, the second antenna portion 20*c* does not detect the RF signal. However other components in the housing should not be radiated by the second antenna portion 20*c* to operate normally To realize this object, as shown in FIG. 5 the stopper portion 20*a* cotacts a ground portion 32 (on the PC board 15) when the second antenna portion 20*c* is retracted into the housing 10. The length from the coupling member 17 to the ground portion 32 (via the second antenna portion 20*c*) is a quarter wavelength. When the holding member 18 is assumed to a standard point, the impedance Z of the second antenna portion 20*c* is described in the expression below.

$$Z \propto \tan(2\pi l/\lambda)$$

l: the lengh of the top 26*a* to the bottom 26*b* of the second antenna portion 20*c*

λ: wavelength

As in the description above. l is a quarter wavelength, thus Z is infinity. Furthermore l may be N times as long as a quarter wavelength where N is an odd number (l=¼λ,¾λ, 5/4λ. . . ). Accordingly, the circuitry of the transceiver 12 does not feed a transmitting signal to the second antenna portion 20*c*, therefore the second antenna portion 20*c* does not radiate other components in the housing 10. Thus, other components are not radiated and not badly influenced by the seccond antenna portion 20*c*, therfore these components operate normally.

As mentioned above, when the second antenna portion 20*c* is retracted into the housing 10, the loading coil 22 being a quarter wavelength is located out of the housing 10. Therefore, even if the second antenna portion 20*c* is retracted, the extendable antenna 20 detects the RF signal.

Generally when the operator does not wish to operate the transceiver, the operator reduces the antanna's projection to make the transceiver a suitable size for carrying. When the RF signal comes to the antenna in the retracted mode, the loading coil 22 detects the RF signal. Therefore, the extendable antenna 20 deters in either mode, and when the transceiver 12 is not being used, the extendable antenna 20 does not require to be extended in advance to detect the RF signal.

Furthermore, it is unnecessary to provide a portable transceiver with the inner antenna, switching means, and the conductive partition wall between the inner antenna and the other components required in the prior art, therefore the size of the housing is reduced. And since the transceiver does not need the inner antenna in a upper portion of the housing, other components may be disposed at the upper portion.

Furthermore, since the loading coil 22 is enclosed into the top end cap 21, when the transceiver 12 is carried, the loading coil 22 is not injured or broken. The loading coil 22 does not vibrate in the top end cap 21, and the quality of voice signal is kept to be good.

After the portable radio transceiver 12 detects the RF signal in the retracted mode, it is preferrable for the operator to extend the antenna until the stopper portion 20*a* is engaged with the tongues 18*a* so that the gain of the antenna becomes larger than the gain of the antenna in the retracted mode.

Figure 6:
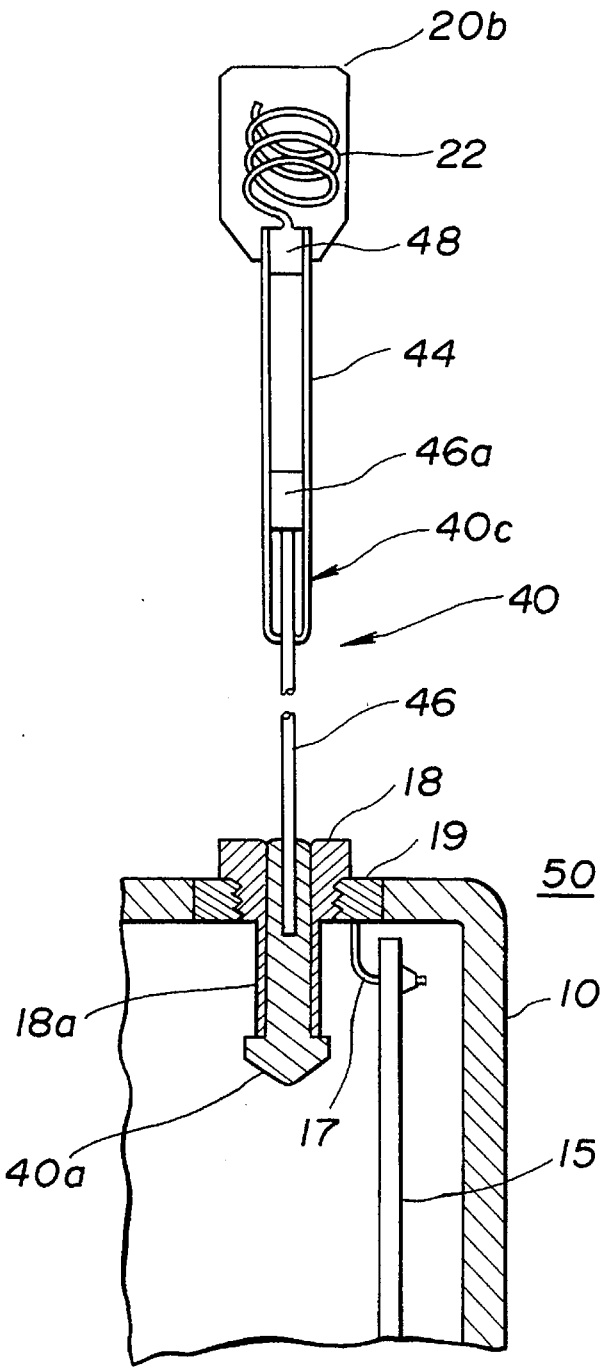
FIG. 6 is a partially cut-away elevational view which illustrates a portable radio transceiver including another embodiment of the invention in the extended mode.
Figure 7:
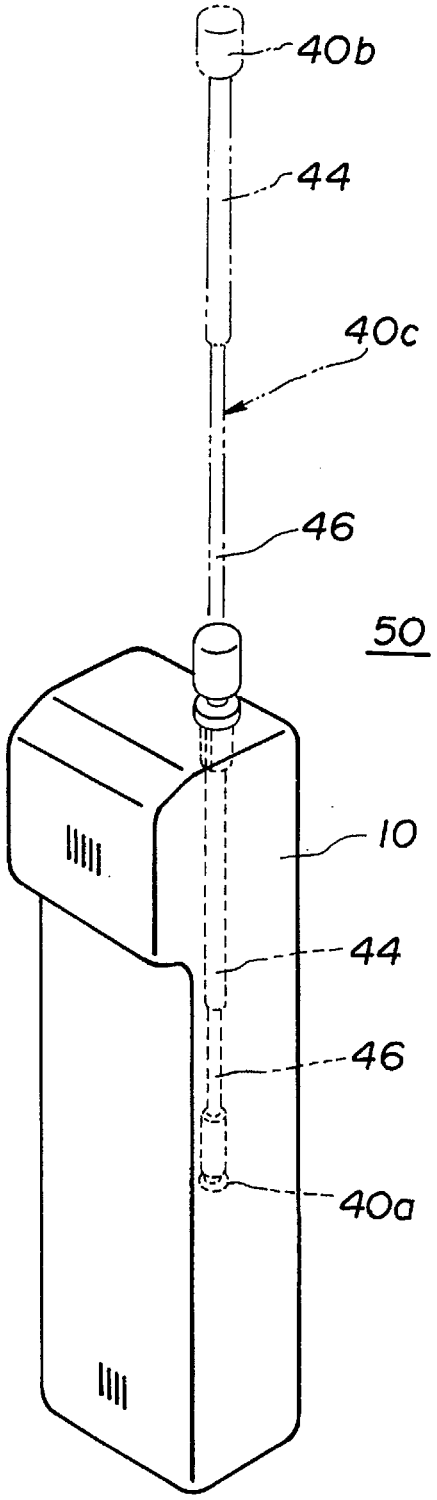
FIG. 7 is a perspective view which illustrates the portable radio transceiver including another embodiment of the invention.
Figure 8:
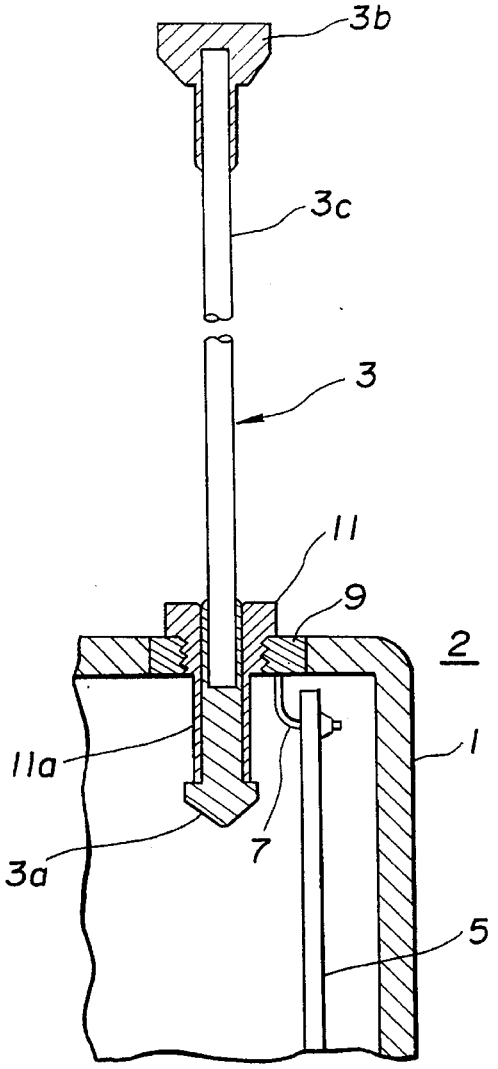
FIG.8 (PRIOR ART)
FIG. 8 is a partially cut-away elevational view which illustrates a portable radio transceiver including a conventional antenna in the extended mode.
Figure 9:
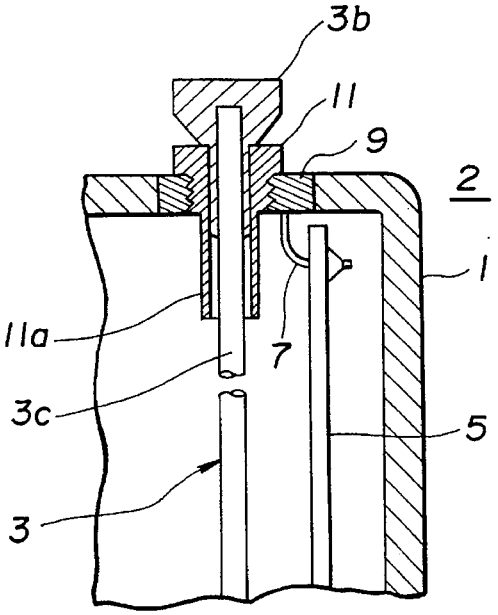
FIG.9 (PRIOR ART)
FIG. 9 is a partially cut-away elevational view which illustrates the portable radio transceiver including the conventinal antenna in the retracted mode.
Figure 10:
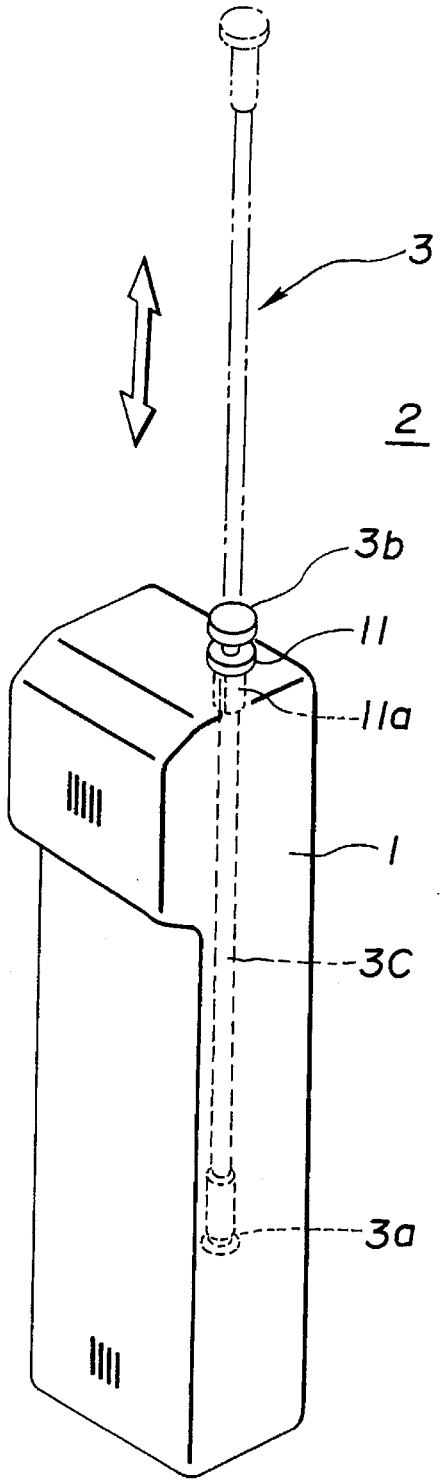
FIG.10 (PRIOR ART)
FIG. 10 is a perspective view which illustrates the portable radio transceiver including the conventional antenna.

In the above embodiment, the second antenna portion 20*c* is only one rod portion. However, the second antenna portion may be extendable itself. This second embodiment is shown in FIG. 6 and FIG. 7. An extendable antenna 40 is provided at the housing or a radio transceiver 50. The antenna 40 has a second antenna portion 40*c*. The second antenna portion 40*c* has a pipe portion 44, a whip portion 46, and a stopper portion 40*a*. The pipe portion 44 is composed of metal. The whip portion 46 is composed of a stainless wire core and a polyoxymethylene coat.

The loading coil 22 is inserted and fitted into a top end of the pipe portion 44. A top end side of the whip portion 46 is inserted and engaged into the pipe portion 44. An engagement portion 46*a* is provided at the top end side of the whip portion 46. The engagement portion 46*a* is a board-shaped spring, therefore the whip portion 46 is slidably engaged in the pipe portion 44. The elastic power of the engagement portion 46*a* is determined to be smaller than that of the tongues 18*a*. In the extended mode, when the top end cap 21 is pushed down toward the housing 10, the engagement portion 46*a* slides in the pipe portion 44 toward the loading coil 22 and strikes against the bottom portion 48*a* of the loading coil 22. When the top end cap 21 is pushed more and more, the pipe portion 44 slides in the tongues 18*a*, and the second antenna portion 40*c* is retracted into the housing 10. Accordingly the shortened second antenna portion 40*c* is retracted into the housing 10, therefore the size of the shortened second antenna 40*c* in the retracted mode is smaller than the size of the second antenna 20*c*, and the space for the shortened second antenna in the housing 10 is smaller than the space for the second antenna 20*c*.

In the description above, the holding member acts as the feeding portion. Instead, the holding member may not be the same as the feeding portion. For example, the feeding portion being differrent from the holding member may be mounted on the PC board.

Furthermore, the loading coil is not always provided with only the first antenna portion. Instead, the loading coils may be provided with the first and second antenna portion. The space for the second antenna in the housing 10 is thus made smaller than the space for the second antenna 20*c*.

The loading coil may be provided at all of the first antenna portion or may be provided at a part of the first antenna portion.

The loading coil is not always enclosed into the top end cap. For example, the loading coil may be exposed or coated by plastic.

The electrical length of the first and second antenna is substatially a quarter wavelength and adjusted and decided so that the antenna may detect the RF signal best.

The electrical length of the first antenna portion may be substantially N times as long as a quarter wavelength where N is an integral number, for example, a half wavelength and three quarters wavelength. Furthermore the electrical length of first antenna portion may be substantially three-eighth wavelength. These lengths are well known as proper lengths of whip antennas.

The ground portion is not always required when other components are entirely shielded and not badly influenced by the second antenna in the retracted mode in the housing. In this embodiment, the length of the second antenna portion is not limited to be N times as long as a quarter wavelength where N is an odd number, therefore the length of the second antenna portion may be the well known proper length.

In the description above, the loading coil acts as a loading portion. Instead, the loading portion may be a ring-shaped capacity or a board-shaped capacity, as is known in the art. The loading portion has an impedance which is equivalent to the impedance of the loading coil being the proper length, for example a quarter wavelength.

In these embodiments, the feed portion is shown touching to the boundary of the first and second antennas. Instead, if the length from the touched position to the top portion of the loading coil is proper, the feed portion may contacts the antenna at another position in retracted mode.

Furthermore, when the transceiver is operated in the area where received signals strength is high, even a loading coil having the electrical length less than a quater wavelength detects RF signal. Therefore, the transceiver is operated in this area, the length of the loading coil may be less than a quater wavelegth.

What is claimed is:

1. An extendable antenna for a radio transceiver provided in a housing, said radio transceiver having a feeding portion electrically connected with circuitry of said transceiver, said extendable antenna comprising:

a first antenna portion having a loading portion;

a second antenna portion including first and second ends;

a conductive connecting portion connecting an end of said first antenna portion to said first end of said second antenna portion, said conductive connecting portion contacting said feeding portion and said first antenna portion being disposed to receive RF signals when said second antenna portion is retracted into said housing; and a conductive stopper portion connected to said second end of said second antenna portion, said conductive stopper portion contacting said feeding portion when said second antenna portion is extended from said housing.

2. An extendable antenna according to claim 1, wherein said loading portion comprises a winding portion coated with nonconductive material.

3. An extendable antenna according to claim 1, wherein said second antenna portion is flexible.

4. An extendable antenna according to claim 1, wherein said second antenna portion has a conductive portion and a non-conductive portion enclosing said conductive portion.

5. An extendable antenna according to claim 1, wherein said feeding portion includes a holding member for holding said conductive stopper portion when said second antenna portion is extended from said housing and for holding said conductive connecting portion when said second antenna portion is retracted into said housing.

6. An extendable antenna according to claim 1, wherein said second antenna portion has a conductive hollow portion having an inner surface and a core portion having an engagement portion at an end of said core portion, said engagement portion being in sliding engagement with said inner surface of said conductive hollow portion.

7. An extendable antenna according to claim 6, wherein said feeding portion includes a holding member for holding said conductive stopper portion when said second antenna portion is extended from said housing and for holding said conductive connecting portion when said second antenna portion is retracted into said housing, and an engagement force of said engagement portion of said core portion engaging said inner surface of said conductive hollow portion is smaller than a holding force of said holding member holding said conductive stopper portion.

8. An extendable antenna device for a radio transceiver provided in a housing, said extendable antenna device comprising:

a feeding portion disposed to said housing and electrically connected with circuitry of said transceiver; and an extendable antenna comprising:

a first antenna portion having a loading portion;

a second antenna portion including first and second ends;

a conductive connecting portion connecting an end of said first antenna portion to said first end of said second antenna portion, said conductive connecting portion contacting said feeding portion and said first antenna portion being disposed to receive RF signals when said second antenna portion is retracted into said housing; and a conductive stopper portion connected to said second end of said second antenna portion, said conductive stopper portion contacting said feeding portion when said second antenna portion is extended from said housing.

9. An extendable antenna for a radio transceiver, said radio transceiver having a feeding portion electrically connected with circuitry of said transceiver, said extendable antenna comprising:

a first antenna portion having a loading portion;

a second antenna portion including first and second ends;

a conductive connecting portion connecting an end of said first antenna portion to said first end of said second antenna portion, said conductive connecting portion contacting said feeding portion and said first antenna portion being disposed to receive RF signals when said second antenna portion is retracted into said transceiver; and a conductive stopper portion connected to said second end of said second antenna portion, said conductive stopper portion contacting said feeding portion when said second antenna portion is extended from said transceiver.

10. An extendable antenna for a radio transceiver provided in a housing, said radio transceiver having a feeding portion electrically connected with circuitry of said transceiver, said extendable antenna comprising:

a first antenna portion having a loading portion;

a second antenna portion;

a conductive connecting portion connecting said first antenna portion to said second antenna portion, said conductive connecting portion contacting said feeding portion and said first antenna portion being disposed to receive RF signals when said second antenna portion is retracted into said housing; and a conductive stopper portion connected to said second antenna portion, said conductive stopper portion contacting said feeding portion when said second antenna portion is extended from said housing.

11. An extendable antenna for a radio transceiver, said radio transceiver having a feeding portion electrically connected with circuitry of said transceiver, said extendable antenna comprising:

a first antenna portion having a loading portion;

a second antenna portion including first and second ends;

a conductive connecting portion connecting an end of said first antenna portion to said first end of said second antenna portion, said conductive connecting portion contacting said feeding portion and said first antenna portion being disposed to receive RF signals when said extendable antenna is shortened by at least a predetermined amount; and a conductive stopper portion connected to said second end of said second antenna portion, said conductive stopper portion contacting said feeding portion when said second antenna portion is extended from said housing.

12. An extendable antenna for a radio transceiver, said radio transceiver having a feeding portion electrically connected with circuitry of said transceiver, said extendable antenna comprising:

a first antenna portion having a loading portion;

a second antenna portion including first and second ends;

a conductive connecting portion connecting an end of said first antenna portion to said first end of said second antenna portion, said conductive connecting portion contacting said feeding portion and said first antenna portion being disposed to receive RF signals when said extendable antenna is reduced in length at least a predetermined amount; and a conductive stopper portion connected to said second end of said second antenna portion, said conductive stopper portion contacting said feeding portion when said second antenna portion is extended from said housing.

13. An extendable antenna for a radio transceiver provided in a housing, said radio transceiver having a feeding portion electrically connected with circuitry of said transceiver, said extendable antenna comprising:

a first antenna portion having a loading portion;

a first conductive portion, an end of said loading portion being inserted into said first conductive portion;

a second conductive portion having first and second opposing ends, said first conductive portion being inserted into said first end of said second conductive portion, said second conductive portion contacting said feeding portion and said first antenna portion being disposed to receive RF signals when said extendable antenna is retracted;

a second antenna portion inserted into said second end of said second conductive portion; and a conductive stopper portion connected to said second antenna portion, said conductive stopper portion contacting said feeding portion when said extendable antenna is extended from said housing.

14. An extendable antenna for a radio transceiver having circuitry and a feeding portion electrically coupled to the circuitry, comprising:

an extendable antenna portion having a first conductive portion at one end and an opposite end; and a loading antenna portion, including a second conductive portion, connected to the opposite end of said extendable antenna portion, wherein said extendable antenna portion is mounted for extension to an extended position in which said extendable antenna portion is coupled to the feeding portion via said first conductive portion and for retraction to a retracted position in which said loading antenna portion is coupled to the feeding portion via said second conductive portion and the loading antenna portion is disposed to receive RF signals.

15. An extendable antenna according to claim 14, wherein an electrical length of the loading antenna portion is substantially N times as long as a quarter wavelength, where N is an odd number.

16. An extendable antenna for a radio transceiver provided in a housing, said radio transceiver having a feeding portion electrically connected with circuitry of said radion transceiver, comprising:

first antenna means having a loading portion and a conductive portion at an end of said first antenna means; and second antenna means connected to said conductive portion;

wherein when said extendable antenna is shortened by at least a predetermined amount, said loading portion is connected to said circuitry via said conductive portion and at least a predetermined amount of the first antenna means is located out of said housing.

17. An extendable antenna for a radio transceiver having circuitry provided in a housing, comprising:

first antenna means having a loading portion and a first conductive portion; and second antenna means connected to said first conductive portion and having a second conductive portion;

wherein when said extendable antenna is extended, said second antenna means is connected to said circuitry via said second conductive portion, and when said extendable antenna is shortened by at least a predetermined amount, said loading portion is connected to said circuitry via said conductive portion and at least a predetermined amount of said first antenna means is located out of said housing.

18. An antenna for a radio transceiver having circuitry included in a housing, comprising:

first antenna means having a loading portion and a conductive portion; and second antenna means connected to said conductive portion;

wherein when said antenna is shortened by at least a predetermined amount, said loading portion is connected to said circuitry via said conductive portion and at least a predetermined amount of said first antenna means is located out of said housing.

19. A radio transceiver comprising:

a circuitry included in a housing; and an antenna comprising:

first antenna means having a loading portion and a conductive portion; and second antenna means connected to said conductive portion;

wherein when said antenna is shortened by at least a predetermined amount, said loading portion is connected to said circuitry via said conductive portion and at least a predetermined amount of said first antenna means is located out of said housing.

20. An extendable antenna for a radio transceiver enclosed in a housing, said radio transceiver having a feeding portion electrically connected with circuitry of said transceiver, said extendable antenna comprising:

a loading coil disposed in a top portion of said extendable antenna;

a bottom portion for connecting said extendable antenna with said feeding portion when said extendable antenna is extended from said housing; and a connecting portion disposed between said loading coil and said bottom portion for connecting said loading coil with said feeding portion when only at least a predetermined amount of said loading coil is located out of said housing.

21. An extendable antenna for a radio transceiver enclosed in a housing, said radio transceiver having a feeding portion electrically connected with circuitry of said transceiver, said extendable antenna comprising:

a first portion including a loading coil and a first conductive portion electrically connected with said loading coil; and a second portion including a second conductive portion, wherein said loading coil is electrically coupled to said feeding portion via said first conductive portion and at least a predetermined amount of said loading coil is located out of said housing when said second portion is retracted into said housing, and said second portion is electrically coupled via said second conductive portion to said feeding portion when said extendable antenna is extended from said housing.

22. An extendable antenna for a radio transceiver enclosed in a housing, said radio transceiver having a feeding portion electrically connected with circuitry of said transceiver, said extendable antenna comprising:

first antenna means including a loading coil and a first conductive portion electrically connected with said loading coil; and second antenna means provided with said first conductive portion including a second conductive portion, wherein when said extendable antenna is extended from said housing, said second conductive portion contacts said feeding portion, and when said second antenna means is retracted into said housing, said first conductive portion contacts said feeding portion.

23. An extendable antenna for a radio transceiver enclosed in a housing, said radio transceiver having a feeding portion electrically connected with circuitry of said transceiver, said extendable antenna comprising:

first antenna means including a loading coil and a first conductive portion electrically connected with said loading coil; and second antenna means provided with said first conductive portion and including a second conductive portion, wherein when said extendable antenna is extended from said housing, said second conductive portion is electrically connected with said feeding portion, and when said second antenna means is retracted into said housing, said first conductive portion is electrically connected with said feeding portion and said loading coil is located out of said housing and at least a predetermined amount of said loading coil is located out of said housing.

24. An extendable antenna as in one of claims 21–23, wherein an electrical length of the first antenna means is substantially the same as an electrical length of the second antenna means.

25. An extendable antenna for a radio transceiver enclosed in a housing, said radio transceiver having a feeding portion electrically connected with circuitry of said transceiver, said extendable antenna comprising:

first antenna means including a loading coil and a first conductive portion electrically connected with said loading coil; and second antenna means provided with said first conductive portion and including a second conductive portion, wherein when said extendable antenna is extended from said housing, said second antenna means is electrically connected with said feeding portion via said second conductive portion, and when said second antenna means is retracted into said housing, said first antenna means is electrically connected with said feeding portion via said first conductive portion.

26. An extendable antenna according to claim 25, wherein an electrical length of the first antenna means is a quarter wavelength and an electrical length of the second antenna means is a quarter wavelength.

27. An extendable antenna according to claim 5, wherein the electrical length of said loading coil is substantially N times as long as a quarter wavelength, where N is an integral number.

28. An extendable antenna according to claim 25, wherein the electrical length of said second antenna means is substantially N times as long as a quarter wavelength, where N is an integral number.

29. An extendable antenna according to claim 25, wherein said radio transceiver has a ground portion, the electrical length from said first conductive portion to said second conductive portion of said second antenna means is substantially N times as long as a quarter wavelength, where N is an odd number, and when said second antenna means is retracted into said housing, said second conductive portion contacts said ground portion.

30. An extendable antenna for a radio transceiver according to claim 25, wherein said first antenna means has a top end cap, said loading coil is enclosed in said top end cap.

31. An extendable antenna for a radio transceiver according to claim 25, wherein said housing has a top portion, said feeding portion is a holding member disposed in said top portion, when said extendable antenna is extended from said housing, said second conductive portion is held by said holding member, when said second antenna means is retracted into said housing, said first conductive portion is held by said holding member.

32. An extendable antenna for a radio transceiver according to claim 31, wherein said second antenna means has a stopper portion disposed in a bottom portion of said second antenna means, said holding member has elastic tongues, when said extendable antenna is extended from said housing, said stopper portion is engaged with said elastic tongues, when said second antenna means is retracted into said housing, said first conductive portion is held by said elastic tongues.

33. An extendable antenna for a radio transceiver according to claim 31, wherein said holding member has a circular hole, said first antenna means has a circular top end cap, with the diameter of said top end cap being larger than the inner diameter of said hole, so that when said second antenna means is retracted into said housing, said top end cap strikes against said housing.

34. An extendable antenna for a radio transceiver according to claim 25, wherein said second antenna means comprises a first elongated portion connected with said first antenna means and a second elongated portion slidably connected with said first elongated portion.

35. An extendable antenna for a radio transceiver according to claim 34, wherein said second elongated portion is comprised of flexible material.

36. An extendable antenna according to claim 25, wherein said second antenna means includes a flexible wire.

37. An extendable antenna for a radio transceiver enclosed in a housing, said radio transceiver having circuitry and a feeding portion electrically connected with the circuitry, said extendable antenna comprising:

first antenna means including a loading coil and a conductive portion electrically connected with said loading coil; and second antenna means provided with said conductive portion, wherein when said second antenna means is retracted into said housing, said loading coil is electrically connected with said feeding portion via said conductive portion and at least a predetermined amount of said loading coil is located out of said housing.

38. An extendable antenna for a radio transceiver enclosed in a housing, said radio transceiver having a feeding portion electrically connected with circuitry of said transceiver, said extendable antenna comprising:

first antenna means including a loading portion and a conductive portion electrically connected with said loading portion; and second antenna means provided with said conductive portion, wherein when said second antenna means is retracted into said housing, said loading portion is electrically connected with said feeding portion via said conductive portion and at least a predetermined amount of said first antenna means is located out of said housing and said first antenna means is disposed to receive RF signals.

39. An extendable antenna in accordance with claim 38, wherein said second antenna portion includes a rod portion.

40. An extendable antenna according to one of claims 1, 8, 39, 9, 10, 11, 12 or 13, wherein an electrical length of the first antenna portion is substantially N times as long as a quarter wavelength, where N is an odd number.

41. An extendable antenna according to claim 38, wherein said second antenna portion includes an elongated portion.

42. An extendable antenna according to claim 38, wherein the first antenna means has a first impedance and said second antenna means has a second impedance, said first and second impedances being the same.

43. A radio transceiver enclosed in a housing, comprising:

a circuitry;

a feeding portion electrically connected with said circuitry; and an extendable antenna comprising:

a loading coil disposed in a top portion of said extendable antenna;

a bottom portion for connecting said extendable antenna with said feeding portion when said extendable antenna is extended from said housing; and a connecting portion disposed between said loading coil and said bottom portion for connecting said loading coil with said feeding portion when only at least a predetermined amount of said loading coil is located out of said housing.

44. A radio transceiver enclosed in a housing, comprising:

a circuitry;

a feeding portion electrically connected with said circuitry; and an extendable antenna comprising:

a first portion including a loading coil and a first conductive portion electrically connected with said loading coil; and a second portion including a second conductive portion, wherein said loading coil is electrically coupled to said feeding portion via said first conductive portion and at least a predetermined amount of said loading coil is located out of said housing when said second portion is retracted into said housing, and said second portion is electrically coupled to said feeding portion via said second conductive portion when said extendable antenna is extended from said housing.

45. A radio transceiver enclosed in a housing, comprising:

a circuitry;

a feeding portion electrically connected with said circuitry; and an extendable antenna comprising:

first antenna means including a loading coil and a first conductive portion electrically connected with said coil; and second antenna means provided with said first conductive portion, wherein when said extendable antenna is extended from said housing, said second antenna means contacts said feeding portion, and when said second antenna means is retracted into said housing, said first conductive portion contacts said feeding portion.

46. A radio transceiver enclosed in a housing, comprising:

a circuitry;

a feeding portion electrically connected with said circuitry; and an extendable antenna comprising:

first antenna means including a loading coil and a first conductive portion electrically connected with said coil; and second antenna means provided with said first conductive portion and including a second conductive portion, wherein when said extendable antenna is extended from said housing, said second conductive portion is electrically connected with said feeding portion, and when said second antenna means is retracted into said housing, said first conductive portion is electrically connected with said feeding portion and said loading coil is located out of said housing, at least a predetermined amount of said loading coil is located out of said housing.

47. A radio transceiver enclosed in a housing comprising:

a circuitry;

a feeding portion electrically connected with said circuitry; and an extendable antenna comprising:

first antenna means including a loading coil and a first conductive portion electrically connected with said coil; and second antenna means provided with said first conductive portion and including a second conductive portion, wherein when said extendable antenna is extended from said housing, said second antenna means is electrically connected with said feeding portion via said second conductive portion, and when said second antenna means is retracted into said housing, said first antenna means is electrically connected with said feeding portion via said first conductive portion, at least a predetermined amount of said loading coil is located out of said housing.

48. A radio transceiver according to claim 47, wherein the electrical length of said loading coil is substantially N times as long as a quarter wavelength, where N is an integral number.

49. A radio transceiver according to claim 47, wherein the electrical length of said second antenna means is substantially N times as long as a quarter wavelength, where N is an integral number.

50. A radio transceiver according to claim 47, wherein said radio transceiver has a ground portion, the electrical length from said first conductive portion to said second conductive portion of said second antenna means is substantially N times as long as a quarter wavelength where N is an odd number, and when said second antenna means is retracted into said housing, said second conductive portion contacts said ground portion.

51. A radio transceiver according to claim 47, wherein said first antenna means as a top end cap, said loading coil is enclosed into said top end cap.

52. A radio transceiver according to claim 47, wherein said housing has a top portion, said feeding portion is a holding member disposed in said top portion, when said extendable antenna is extended from said housing, said second conductive portion is held by said holding member, when said second antenna means is retracted into said housing, said first conductive portion is held by said holding member.

53. A radio transceiver according to claim 52, wherein said second antenna means has a stopper portion disposed in a bottom portion of said second antenna means, said holding member has elastic tongues, when said extendable antenna is extended from said housing, said stopper portion is engaged with said elastic tongues, when said second antenna means is retracted into said housing, said first conductive portion is held by said elastic tongues.

54. A radio transceiver according to claim 52, wherein said holding member has a circular hole and said first antenna means has a top end cap, said top end cap is circular, with the diameter of said top end cap being larger than the inner diameter of said hole, so that when said second antenna means is retracted into said housing, said top end cap strikes against said housing.

55. A radio transceiver according to claim 47, wherein said second antenna means comprises a first elongated portion connected with said first antenna means and a second elongated portion slidably connected with said first elongated portion.

56. A radio transceiver according to claim 55, wherein said second elongated portion is comprised of flexible material.

57. A radio transceiver according to claim 47, wherein said second antenna means includes a flexible wire.

58. A radio transceiver enclosed in a housing comprising:

a circuitry;

a feeding portion electrically connected with said circuitry; and an extendable antenna comprising:

first antenna means including a loading coil and a conductive portion electrically connected with said coil; and second antenna means provided with said conductive portion, wherein when said second antenna means is retracted into said housing, said loading coil is electrically connected with said feeding portion via said conductive portion.

59. A radio transceiver enclosed in a housing comprising:

a circuitry;

a feeding portion electrically connected with said circuitry; and an extendable antenna comprising:

first antenna means including a loading portion and a conductive portion electrically connected with said loading portion; and second antenna means provided with said conductive portion, wherein when said second antenna means is retracted into said housing, said loading portion is electrically connected with said feeding portion via said conductive portion and at least a predetermined amount of said first antenna means is located out of said housing and said first antenna means is disposed to receive RF signals.

60. A radio transceiver according to claim 59, wherein the first antenna means has a first impedance and said second antenna means has a second impedance, said first and second impedances being the same.

* * * * *

UNITED STATES PATENT AND TRADEMARK OFFICE

CERTIFICATE OF CORRECTION

PATENT NO. : 5,583,519

DATED : December 10, 1996

INVENTOR(S) : Noboru KOIKE

It is certified that error appears in the above-indentified patent and that said Letters Patent is hereby corrected as shown below:

Claim 22, Column 10, Line 33, after "portion" (first occurrence) insert --and--.

Claim 24, Column 10, Line 57, change "21-23" to --22 or 23--.

Claim 27, Column 11, Line 14, change "5" to --25--.

Claim 39, Column 12, Line 29, change "portion" (first occurrence) to --means--.

Claim 40, Column 12, Line 31, delete "39".

Claim 41, Column 12, Line 35, change "portion" (first occurrence) to --means--.

Signed and Sealed this

Eighth Day of July, 1997

Bruce Lehman

*Attest:*

BRUCE LEHMAN

*Attesting Officer*

*Commissioner of Patents and Trademarks*